US009829286B2

(12) United States Patent
Skrepetos

(10) Patent No.: US 9,829,286 B2
(45) Date of Patent: Nov. 28, 2017

(54) SYSTEM, METHOD, AND DEVICE FOR ELECTRONICALLY DISPLAYING ONE SHOT AT A TIME FROM MULTIPLE TARGET SHOTS USING ONE PHYSICAL TARGET

(71) Applicant: Nicholas Chris Skrepetos, Eugene, OR (US)

(72) Inventor: Nicholas Chris Skrepetos, Eugene, OR (US)

( * ) Notice: Subject to any disclaimer, the term of this patent is extended or adjusted under 35 U.S.C. 154(b) by 31 days.

(21) Appl. No.: 14/054,072

(22) Filed: Oct. 15, 2013

(65) Prior Publication Data

US 2014/0106311 A1 Apr. 17, 2014

Related U.S. Application Data

(60) Provisional application No. 61/750,735, filed on Jan. 9, 2013, provisional application No. 61/714,661, filed on Oct. 16, 2012.

(51) Int. Cl.
*F41J 5/10* (2006.01)

(52) U.S. Cl.
CPC ..... *F41J 5/10* (2013.01)

(58) Field of Classification Search
CPC ..... F41J 5/10
USPC ..... 434/16
See application file for complete search history.

(56) References Cited

U.S. PATENT DOCUMENTS

| | | | | |
|---|---|---|---|---|
| 5,577,733 | A | 11/1996 | Downing | |
| 5,960,411 | A | 9/1999 | Hartman et al. | |
| 6,699,041 | B1 | 3/2004 | Larkin et al. | |
| 7,255,035 | B2 | 8/2007 | Mowers | |
| 7,329,127 | B2 | 2/2008 | Kendir et al. | |
| 2002/0009694 | A1 | 1/2002 | Rosa | |
| 2003/0195046 | A1 | 10/2003 | Bartsch | |
| 2011/0317993 | A1 | 12/2011 | Weissler | |
| 2012/0126002 | A1* | 5/2012 | Rudich | 235/404 |
| 2012/0258432 | A1* | 10/2012 | Weissler | 434/20 |
| 2013/0169820 | A1* | 7/2013 | Stewart | 348/169 |

OTHER PUBLICATIONS

Target-Cam system (www.target-cam.com).

* cited by examiner

*Primary Examiner* — Xuan Thai
*Assistant Examiner* — Robert Bullington
(74) *Attorney, Agent, or Firm* — Mohr Intellectual Property Law Solutions, PC

(57) ABSTRACT

The present invention contemplates a system for improving shooting skill that includes a computer having an executable software program, a camera in electrical communication with a power source and being in data communication with the computer, a laser mounted to the camera, a tripod supporting the camera, a physical target arranged at a predetermined and selectable distance from the camera, a router for providing data communication means between the camera and the computer, a first antenna in data communication with the computer by means of the router, and a light source coupled to the camera.

8 Claims, 8 Drawing Sheets

SYSTEM, METHOD, AND DEVICE FOR ELECTRONICALLY DISPLAYING ONE SHOT AT A TIME FROM MULTIPLE TARGET SHOTS USING ONE PHYSICAL TARGET

PRIORITY CLAIM

Pursuant to 35 USC 119(e), the present invention claims benefit from and priority to provisional patent application No. 61/750,735 titled "System, Method, and Device for electronically displaying one shot at a time from multiple target shots using one physical target" filed with the United States Patent and Trademark Office on 2013 Jan. 9 and provisional patent application No. 61/714,661 titled "System, Method, and Device for electronically displaying one shot at a time from multiple target shots using one physical target" filed with the United States Patent and Trademark Office on 2012 Oct. 16 both applications by the common inventor Nicholas Chris Skrepetos of Eugene, Oreg., USA for all purposes: The entire contents are hereby incorporated by reference as if fully set forth herein.

BACKGROUND

The present invention relates to systems, methods, and devices used to display a first image on a video or computer screen superimposed over a second image and or cycled, alternating images, whereby the second image is the most recent shot hitting a physical target. More specifically, the present invention relates to a computer system, software, at least one camera, and imaging system adapted to show an image of a physical bulls-eye target with the most recent shot depicted on the image even though the most recent shot is one of a plurality of shots already physically present in the physical bulls-eye target and further includes a second image of the shooter taking the shot whereby a correlation of shooter and shot can be made for training certification purposes, for example.

Professional, recreational, and sport shooters often practice shooting rifles, side arms, pistols, pellet, airsoft, shotguns, archery and the like at shooting ranges or galleries. This practice, with live rounds in real weapons, cannot be adequately simulated by lasers, video games, or simulated shooting mechanisms. Common to these live round targeting systems is a paper target or paper bulls-eye target mounted at a predetermined distance from the shooter. The shooter will aim a firearm at the target and fire a round into the target. Commonly, multiple shots are fired into a single paper target. However, as the target becomes saturated with holes from each shot, the shooter has a more difficult time determining the accuracy of the latest and most recent shot. Thus, there is a need for a system that enables each individual shot from a plurality of shots fired at a single physical target to be observed and, ideally, recorded so that the shooter can analyze his or her shooting pattern for improvement and correction.

Currently, attempts to provide a shooter with feedback of his or her shooting skill have not fully addressed this need. For example, Downing, in U.S. Pat. No. 5,577,733 issued on 1996 Nov. 26, teaches a targeting system for a shooter of a gun. The system includes a target image created by a projector and projected on a target screen or pre-printed target, a light panel is disposed between the target and the gun so that a bullet from the gun passes through the light panel, which sends signals indicative of the bullet's location and velocity to a computer. However, one limitation of this system is that it requires a delicate and complicated light panel, which requires maintenance of the light-emitting sources, and can be easily damaged by stray bullets commonly found in a shooting gallery.

Another example of attempts to provide a shooter with assessment of shots includes the teaching of Larkin et al. in U.S. Pat. No. 6,699,041 issued on 2004 Mar. 2. Larkin et al. disclose a self-assessing target with four quadrants wherein each quadrant contains possible causes for why shots are straying from the intended center of the target. However, this system does not suggest, contemplate, motivate, or teach a system for providing a single target with an electronic image that masks previous shots.

A more modern approach to targeting imagery includes the teaching of Mowers in U.S. Pat. No. 7,255,035 issued on 2007 Aug. 14. Therein Mowers discloses a weaponry camera sight with a digital electronic display of the sight picture for the shooter. The display magnifies, thus eliminating a scope sight. The display includes a range finding device and can record the screen image for later playback. However, Mowers does not contemplate, suggest, motivate, or teach a system for providing a single target with an electronic image that masks previous shots.

A more modern approach to a firearm training system includes the teaching of Kendir et al. in U.S. Pat. No. 7,329,127 issued 2008 Feb. 12. Therein Kendir et al. disclose a laser training system including a target assembly, a laser transmitter assembly that attaches to a firearm, a detection device and a processor. A target locates at extended ranges and accounts for various environmental and other conditions. One limitation of the Kendir et al. system is that the laser replaces live rounds, this detracting from the real-world feel of using ammunition. Further, Kendir et al. does not contemplate, suggest, motivate, or teach a system for providing a single target with an electronic image that masks previous shots.

Yet another attempt to provide a system to provide improved feedback to a shooter of his or her shots is the Target-Cam system (www.target-cam.com) currently available on-line. This system includes a camera and target portable wireless digital spotting scope for target shooting and rifle and handgun sighting. The Target-Cam systems use a wireless video camera and a hand-held 3.5" color display that allows target shooters to view every target hit instantly from up to 300 yards away. However, this system does not contemplate, suggest, motivate, or teach a system for providing a single target with an electronic image that masks previous shots, nor does it provide a computer with software capable of analyzing shots.

Despite these attempts to provide a shooter with feedback of shots fired at a physical or virtual target, there remains a need for a system that utilizes a single physical target for multiple shots fired by a conventional weapon, yet displays one shot at a time on a screen and thus masks previous shots. Further, such a system should also provide analysis tools and capability so that the shooter can assess the skill of the shots and make improvements.

DRAWING

DESCRIPTION OF THE INVENTION

Figure 1:
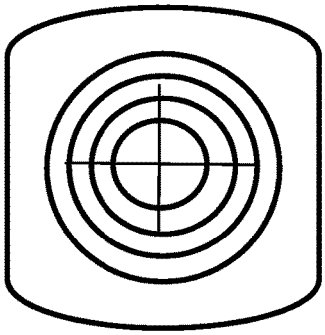
FIG. 1 is a representation of a physical target prior to being hit with ammunition according to a first preferred embodiment of the present invention.
Figure 2:
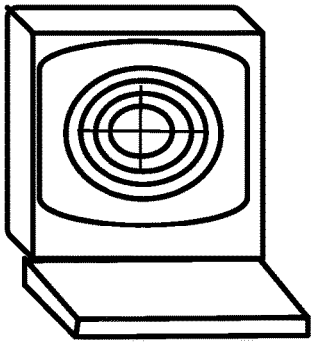
FIG. 2 is a representation of a computer and software of the embodiment of FIG. 1 and shows a screen image of the physical target prior to being hit with ammunition.
Figure 3:
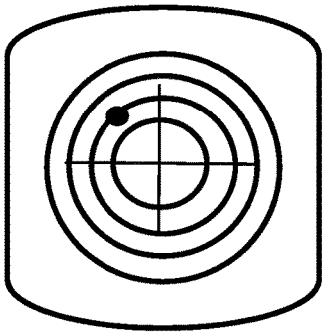
FIG. 3 is the target of FIG. 1 after being hit with a first round.
Figure 4:
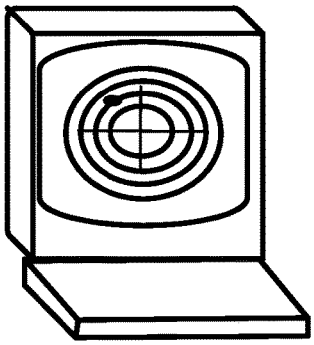
FIG. 4 is the screen image displayed on the computer using the software of the present invention and corresponds to the physical shot of FIG. 3.
Figure 5:
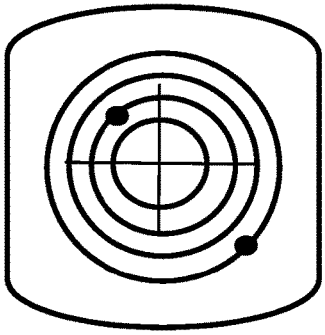
FIG. 5 shows a second shot on the physical target of FIG. 1.
Figure 6:
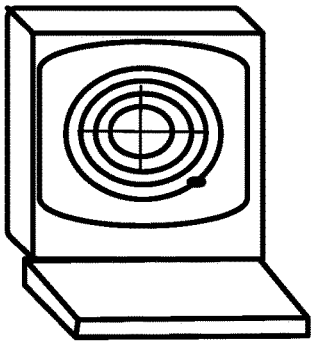
FIG. 6 is the screen image displayed on the computer using the software of the present invention and corresponds to the physical shot of FIG. 5.
Figure 7:
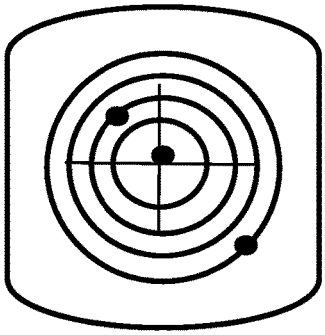
FIG. 7 shows a third shot on the physical target of FIG. 1.
Figure 8:
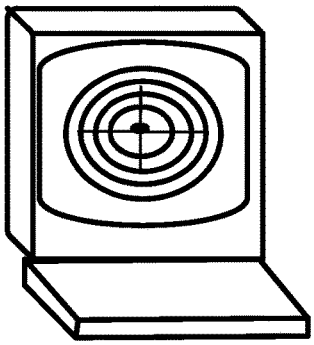
FIG. 8 is the screen image displayed on the computer using the software of the present invention and corresponds to the physical shot of FIG. 7.
Figure 9:
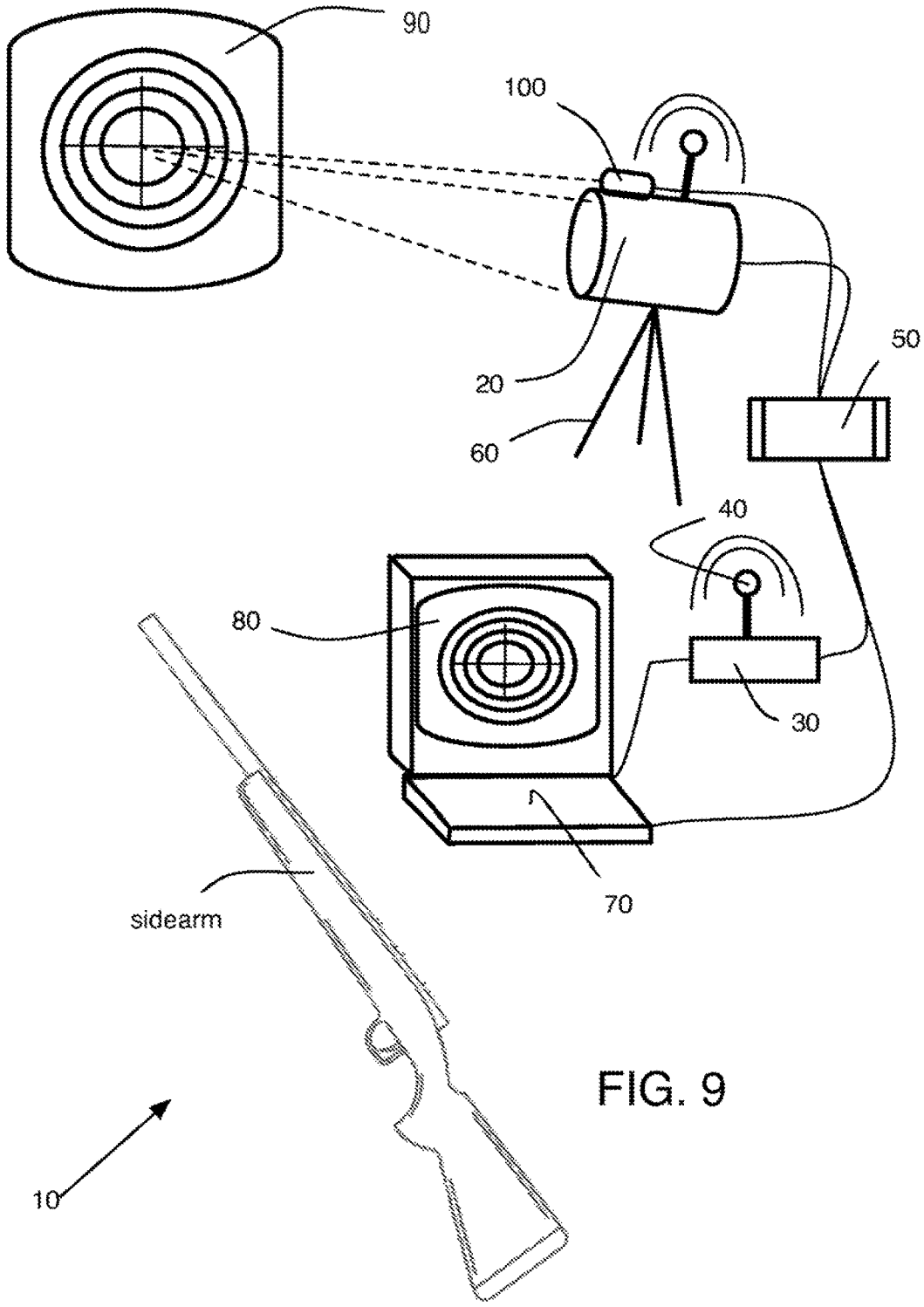
FIG. 9 is a schematic diagram of the system according to a first preferred embodiment of the present invention.

Possible embodiments will now be described with reference to the drawings and those skilled in the art will understand that alternative configurations and combinations of components may be substituted without subtracting from the invention. Also, in some figures certain components are omitted to more clearly illustrate the invention.

The following disclosure includes definitions of selected terms used. The definitions include various examples and/or forms of components that fall within the scope of a particular term and can be used to implement the disclosed methods. The examples are not intended to be limiting and both singular and plural forms of terms may be within the definitions.

As used in this application, the term "computing unit" refers to a computer-related entity, hardware, firmware, software, a combination thereof, or software in execution. For example, a computing unit can be, but is not limited to being, a process running on a processor unit, a processor, an object, an executable, a thread of execution, a program, and a computer. By way of illustration, both an application running on a server and the server can be computing units. One or more computing units can reside within a process and/or thread of execution and a computing unit can be localized on one computer and/or distributed between two or more computers.

The term "system memory," as used herein, refers to a medium that participates directly or indirectly to provide signals, instructions and/or data. A system memory may take forms, including, but not limited to, non-volatile media, and volatile media. Non-volatile media may include, for example, optical or magnetic disks and so on. Volatile media may include, for example, optical or magnetic disks, dynamic memory and the like. Common forms of a system memory include computer-readable medium such as, but are not limited to, a floppy disk, a flexible disk, a hard disk, a magnetic tape, other magnetic medium, a CD-ROM, other optical medium, punch cards, paper tape, other physical medium with patterns of holes, a RAM, a ROM, an EPROM, a FLASH-EPROM, or other memory chip or card, a memory stick, and other media from which a computer, a processor or other electronic device can read.

The term "shared data storage," as used herein, refers to a physical and/or logical entity that can store data. Data storage may be, for example, a database, a table, a file, a list, a queue, a heap, a memory, a register, a file directory, a storage location, and so on. Data storage may reside in one logical and/or physical entity and/or may be distributed between two or more logical and/or physical entities.

The term "logic," as used herein, includes but is not limited to hardware, firmware, software and/or combinations of each to perform a function(s) or an action(s), and/or to cause and execute a function or action from another logic, method, and/or system. For example, based on a desired application or needs, logic may include a software controlled microprocessor, discrete logic like an application specific integrated circuit (ASIC), a programmed logic device like a field programmable gate array (FPGA), a memory device containing instructions, combinations of logic devices, or the like. Logic may include one or more gates, combinations of gates, or other circuit components. Logic may also be fully embodied as software, or may be a computing unit as defined herein. Where multiple logical logics are described, it may be possible to incorporate the multiple logical logics into one physical logic. Similarly, where a single logical logic is described, it may be possible to distribute that single logical logic between multiple physical logics.

The term "software," as used herein, includes but is not limited to, one or more computer or processor instructions that can be read, interpreted, compiled, and/or executed and that cause a computer, processor, or other electronic device to perform functions, actions and/or behave in a desired manner. The instructions may be embodied in various forms like routines, algorithms, feature sets, methods, threads, and/or programs including separate applications or code from dynamically linked libraries. Software may also be implemented in a variety of executable and/or loadable forms including, but not limited to, a stand-alone program, a function call (local and/or remote), a servelet, an applet, instructions stored in a memory, part of an operating system or other types of executable instructions. It will be appreciated by one of ordinary skill in the art that the form of software may be dependent on, for example, requirements of a desired application, the environment in which it runs, and/or the desires of a designer/programmer or the like. It will also be appreciated that computer-readable and/or executable instructions can be located in one logic and/or distributed between two or more communicating, cooperating, and/or parallel processing logics and thus can be loaded and/or executed in serial, parallel, massively parallel and other manners.

Suitable software for implementing the various components of the example systems and methods described herein include programming languages and tools like Java, Pascal, C#, C++, C, CGI, Perl, PHP, SQL, APIs, SDKs, assembly, firmware, microcode, and/or other languages and tools. Software, whether an entire system or a component of a system, may be embodied as an article of manufacture and maintained or provided as part of a computer-readable memory as indicated previously. Another form of the software may include signals that transmit program code of the software to a recipient over a network or other communication medium. Thus, in one example, a computer-readable medium has a form of signals that represent the software/firmware as it is downloaded from a web server to a user. In another example, the computer-readable medium has a form of the software/firmware as it is maintained on the web server. Other forms may also be used.

The term "user," as used herein, includes but is not limited to one or more persons, software, computers or other devices, or combinations of these. A user may also be a real person that is an individual, or is part of a group, organization, company, team or other arrangement of people whether formed formally in a legal entity or otherwise.

Software Designed to Run on a Computerized System

In one preferred embodiment, the present invention contemplates a software tool to be run on a computer system that has at least one user, but preferably a plurality of users. The software is designed to enable an organization, team, group, or individual to manage disparate processes with an over-riding feature of linking and executing strategic plans and budgets to activities within the scheme of the end-to-end process and specific tasks and subtasks to be performed by unique individuals, teams, or groups within the organization. The software tool, recognizing that any individual user will have a unique experience and comfort level with the software tool, further is configured to enable user-customizable business rules, terminology, templates, and user interface. This allows for the individual or organization to tailor the software to suit their business needs and increases the adoption (acceptance rate by users is increased). Further, real-time presentation of data enables the system to create a flexible table that adjusts to the user input in real-time.

Various examples of the present invention may be implemented using electronic circuitry (not shown) configured to perform one or more functions. For example, with some embodiments of the invention, the online method may be implemented using one or more ASICs. More typically, however, components of various examples of the invention will be implemented using a programmable computing device or computer 800 (800A and 800B) executing firmware or software instructions, or by some combination of purpose-specific electronic circuitry and firmware or software instructions executing on a programmable computing device or computer.

Figure 16:
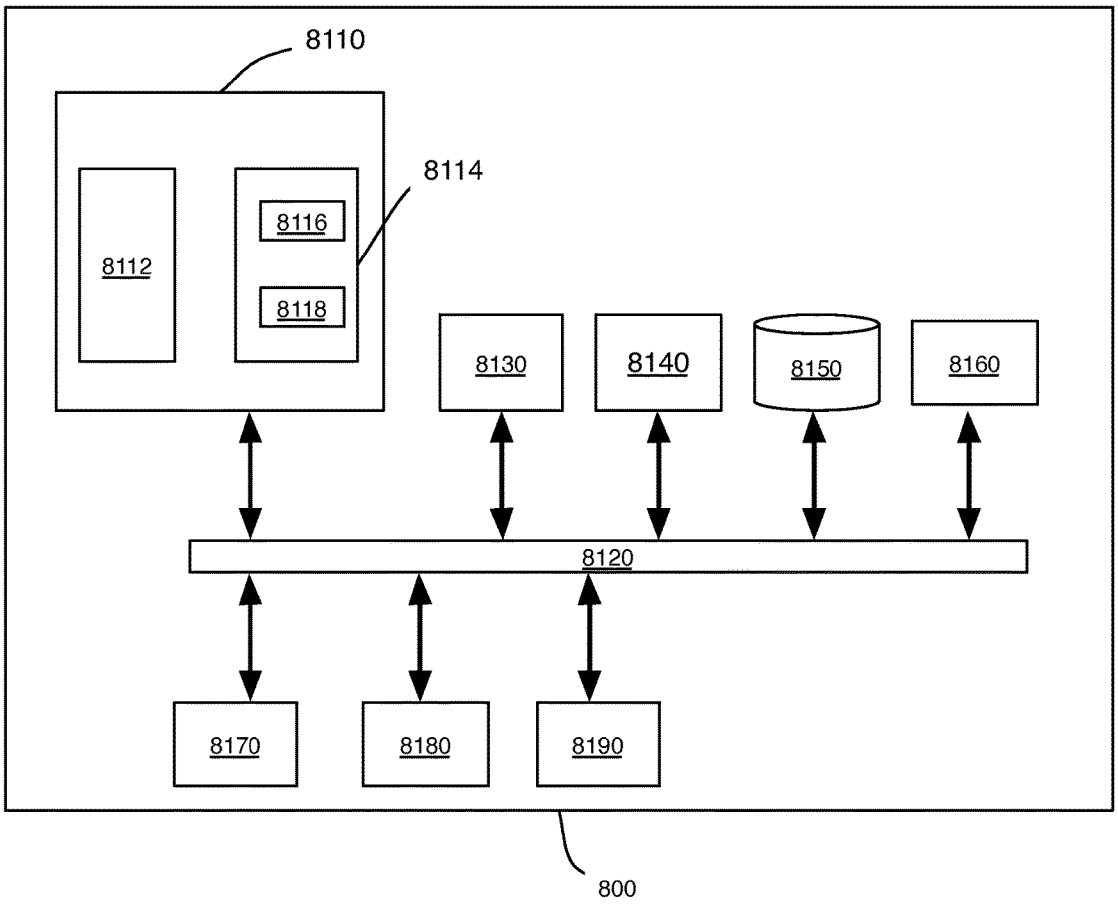
FIG. 16 is a schematic diagram of a computer system configured to run a software device according to the present invention.

Accordingly, FIG. 16 shows one illustrative example of a computer 800 that can be used to implement various embodiments of the invention. The computer 800 may be incorporated within a variety of electronic devices, such as personal computers, desktop computers, servers, tablet computers, cellular phones, smart phones, personal data assistants, global positioning system devices, and the like.

As seen in FIG. 16, computer 800 has a computing unit 8110. Computing unit 8110 typically includes a processor or processing unit 8112 and a system memory 8114. Processing unit 8112 may be any type of processing device for executing software instructions, but will conventionally be a microprocessor device. System memory 8114 may include both a read-only memory (ROM) 8116 and a random access memory (RAM) 8118. As will be appreciated by those of ordinary skill in the art, both read-only memory (ROM) 8116 and random access memory (RAM) 8118 may store software instructions to be executed by processing unit 8112.

Processing unit 8112 and system memory 8114 are connected, either directly or indirectly, through a bus 8120 or alternate communication structure to one or more peripheral devices. For example, processing unit 8112 or system memory 8114 may be directly or indirectly connected to additional memory storage, such as a removable magnetic disk drive 8140, a hard disk drive 8150, a flash memory card 8160, and a removable optical disk drive 8170. Processing unit 8112 and system memory 8114 also may be directly or indirectly connected to one or more input devices 8180 and one or more output devices 8190. Input devices 8180 may include, for example, a keyboard, touch screen, a remote control pad, a pointing device (such as a mouse, touchpad, stylus, trackball, or joystick), a scanner, a camera or a microphone. Output devices 8190 may include, for example, a monitor display, an integrated display, television, printer, stereo, or speakers.

Still further, computing unit 8110 will be directly or indirectly connected to one or more network interfaces 8130 for communicating with a network. This type of network interface 8130, also sometimes referred to as a network adapter or network interface card (NIC), translates data and control signals from computing unit 8110 into network messages according to one or more communication protocols, such as the Transmission Control Protocol (TCP), the Internet Protocol (IP), and the User Datagram Protocol (UDP). These protocols are well known in the art, and thus will not be discussed here in more detail. An interface 8130 may employ any suitable connection agent for connecting to a network, including, for example, a wireless transceiver, a power line adapter, a modem, or an Ethernet connection.

It should be appreciated that, in addition to the input, output and storage peripheral devices specifically listed above, the computing device 800 may be connected to a variety of other peripheral devices, including some that may perform input, output and storage functions, or some combination thereof.

Computer 800 may be connected to or otherwise include one or more other peripheral devices, such as a telephone (not shown). The telephone may be, for example, a wireless "smart phone," such as PHONE® or Droid® brand smart phones. As known in the art, this type of telephone communicates through a wireless network using radio frequency transmissions. In addition to simple communication functionality, a "smart phone" may also provide a user with one or more data management functions, such as sending, receiving and viewing electronic messages (e.g., electronic mail messages, SMS text messages, etc.), recording or playing back sound files, recording or playing back image files (e.g., still picture or moving video image files), viewing and editing files with text (e.g., Microsoft Word or Excel files, or Adobe Acrobat files), etc. Because of the data management capability of this type of telephone, a user may connect the telephone with computer 800 so that their data maintained may be synchronized.

Of course, still other peripheral devices may be included with or otherwise connected to a computer 800 of the type illustrated in FIG. 16, as is well known in the art. In some cases, a peripheral device may be permanently or semi-permanently connected to computing unit 8110. For example, with many computers, computing unit 8110, hard disk drive 8150, removable optical disk drive 8170, and a display (not shown) are semi-permanently encased in a single housing.

Still other peripheral devices may be in operable communication with, and operable connection to the computer 800, however. Computer 800 may include, for example, one or more communication ports (not shown) through which a peripheral device can be connected to computing unit 8110

(either directly or indirectly through bus 8120). These communication ports may thus include a parallel bus port or a serial bus port, such as a serial bus port using the Universal Serial Bus (USB) standard or the IEEE 1394 High Speed Serial Bus standard (e.g., a Firewire port). Alternately or additionally, computer 800 may include a wireless data "port," such as a Bluetooth® interface, a Wi-Fi interface, an infrared data port, or the like.

It should be appreciated that a computing device 800 may include more components than computer 800 illustrated in FIG. 16, fewer components than computer 800, or a different combination of components than computer 800. Some implementations of the invention, for example, may employ one or more computing devices 800 that are intended to have a very specific functionality, such as a smart phone or server computer. These computing devices may thus omit unnecessary peripherals, such as the network interface 8130, removable optical disk drive 8140, printers, scanners, external hard drives, etc. Some implementations of the invention may alternately or additionally employ computing devices 800 that are intended to be capable of a wide variety of functions, such as a desktop or laptop personal computer. These computing devices 800 may have any combination of peripheral devices or additional components as desired.

For purposes of explaining the contemplated software tool and intrinsic method of the various preferred embodiments, a conceptual feature set is used herein as a means for explaining the function and construct of the software, but should not be used as a literal, limiting construct of software development. Broadly, feature set, as used herein refers generally to describing the functionality of the software tool into discrete, perhaps independent, feature sets as a way to describe aspects of the present invention. Conceptually, feature sets represent a serration of concerns or functions to achieve a result or to transform data or data-elements. Concerns or functions are separated (at least conceptually) so that feature sets perform logically discrete functions or operations or steps. Feature sets may interact with other feature sets of the system or may be highly independent from other feature sets. Conceptually, a feature set can operate independently to another feature set, or can use output from another feature set to trigger a particular feature set to operate. At least one feature set, or as contemplated conceptually herein, several feature sets cooperating and/or operating autonomously compile to construct the executable application program of the software tool of the present invention.

The present invention, as appreciated by those having ordinary skill in the art, can be represented in many different computer-readable languages, including, but not limited to Ada, Algol, BlitzMax, COBOL, Component Pascal, D, Erlang, F, Fortran, Haskell, IBM/360 Assembler, IBM RPG, Java, C++, and others, for example.

Discussion of Preferred Embodiments

In one preferred embodiment, the system 10 includes a camera 20, router 30, an antenna 40, a portable power source (battery) 50, a tripod 60, and a computer 70 having specific software 80. The system also includes a booster and, optionally, a YAGI antenna for relaying data over 1-mile, for example. Further, the system also includes a light 90 for night shooting. The present invention improves over existing art because there is no modification to the shooters firearm, meaning that the shooter can bring his or her own weapons, and the system 10 will work with any weapon. Also, the present invention, once set up, allows the shooter to select and swap which weapons he is using for practice. Other benefits include providing a data file that can be reviewed at a later date or time for certification use or for training purposes. Also, the system can work in real time so that the shooter can monitor his or her shots and make adjustments to the firearm or the shooting style, or both.

Those skilled in the art will appreciate that the computer need not be in close proximity to the camera. The camera and signal router and computer can be dispersed over several physical locations. For example, the computer may be positioned adjacent to the shooter, a first camera may be placed near the target, a second camera may be placed behind the shooter, and the router may be placed in a location that provides either cabled or wireless signals from each camera and relays, and or processes those signals than transfers a new signal, to the computer.

In one preferred embodiment, the system includes a FOSCAM brand and model no. F18905W outdoor camera available from www.focsm.us, an EZOPower brand and model number 7800MAH DUAL USB Rechargeable Battery Pack available from mwave.com, a CNETUSA brand and model no. CQR-980 Router available from cnetusa.com, a 9 DBI Antenna Added to Router, a Sunpak brand and model no, 5200D Tripod available, a 5V Charger for Battery Pack, a USB->3.5 MM Barrel Connector Wire for Camera Power, a USB->MiniUSB Connector Wire for Router Power, a Toolbox that contains product that has foam insert where all components stat except for Camera, Tripod and USB Drive, and a USB Drive with the Software on it, so it's portable, for example. Many of these components are easily obtainable from a myriad of on-line suppliers as would be generally understood in the art.

In one preferred embodiment, the computer 70 is a Windows based laptop, but in other embodiments a MAC-based operating system is supported, as are applications for smartphones and tablets including the iPhone, iPad and Andoid Tablets, for example.

Once the physical components of the system are set up, the computer and software direct the user to focus the camera on the physical target. The user is prompted to capture an image of the physical target before any shots are fired. Then, the user takes his or her shooting position and initiates the shot-capture mode of the software. The most recent (current) shot is indicated on the computer screen by blinking a first color and/or image of what changed on the target—such as, for example, the actual bullet image or impression made by the bullet.

Laser 100 is used on the camera (attached) to position camera pointing at the target so the software can see it—the software does not see the laser, but it just means the camera is aligned without having to view the screen and camera at the same time.

The system is configured so that the user can mark/label/color-code each shot so that each individual shot can be readily identified by a myriad of characteristics including the name of the individual that made the shot, the time of day, date, and other indicia, for example. This enables multiple uses and/or users of a single physical paper target. And, another key feature is the ability to digitally alternate screen views between two or more images to give the viewer new information by rapidly altering a more recent image with a previous image so that the new matter (i.e. the location of a bullet hole on a target from a new shot fired at the target) "stands out" to the viewer. In addition to color-coding each shot, the user can tag each shot with the Firearm, Ammunition, Time/Date and other details that will be important to shooters.

The software solution allows the user/shooter to enter all relevant information including the location of the shooting, the target distance, type of firearm, ammunition used, etc.

After a shooting a shot at the physical target, the user then inputs (button click, remote button, mouse, voice-command, or otherwise inputs to the computer to inform the software that the shot has been taken. Then, the software uses the previous image captured and the current image to alternate between which "shows" the shot (the difference in the image) blinking. The software can distinguish different shots by enabling the user to input data relating to the shot after each shot. For example, the shooter can use the mouse to mark (tag, and or color) the hole that is blinking and associate who the shooter was, what type of weapon, type of ammunition, location, date, etc. The software also allows for electronic zoom, cropping, saving, etc.—as well as exporting the images to post in community blogs or to save (i.e. .jpg or .png formatted files) for any other purpose. For example, military and law enforcement officers may want to save their target shooting profile to serve as evidence for their yearly qualification certification.

Figure 11:
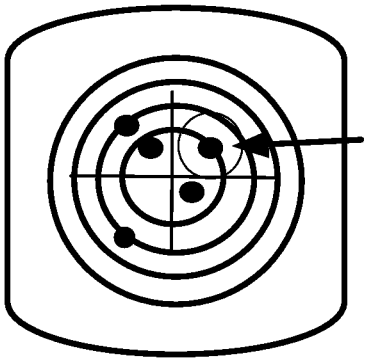
FIG. 11 shows a method of the present invention and represents a physical target.
Figure 12:
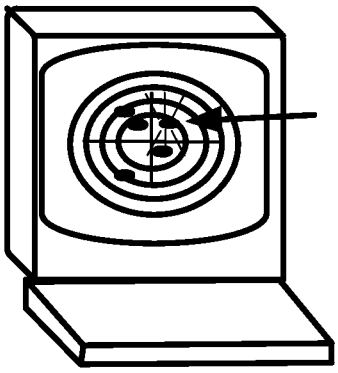
FIG. 12 shows another step of the method of FIG. 11 and represents a screen image.

In another embodiment, as FIGS. 11 and 12 illustrate, the software configures to enable the user to select displaying the most recent shot as a blinking or flashing icon, or preferably an image of the actual shot showing the target and the impression or bullet embedded in the target, on the screen with the target in the background and each previous shot also being displayed. In FIGS. 11 and 12 a lead-arrow points out the most recent shot on the physical target (FIG. 11) in a grouping of previous shots and the computer (FIG. 12) highlights this most recent shot by flashing or blinking the bullet icon on the target. The user can then tag the blinking shot by clicking on the mouse or other input device, and associate any characteristic with that shot (person's name, weapon, ammunition, etc., as previously discussed) and then the computer system will be ready to capture the next shot, converting the present shot to a non-blinking icon, and so on for each subsequent shot. Of course, the software can configure to display any combination or subset of previously captured shots. For example, a user may wish to display the last n-shots. Or, the user may wish to show all shots fired by a particular firearm using a particular ammunition type. For multiple shooters, the user may wish to see all of shooter#1's shots, and so on.

It will be appreciated by those skilled in the art that smart phones, tablet computers, laptops, personal desktop assistance and other similar devices are also contemplated for use including iPad, and the iPhone.

Figure 10:
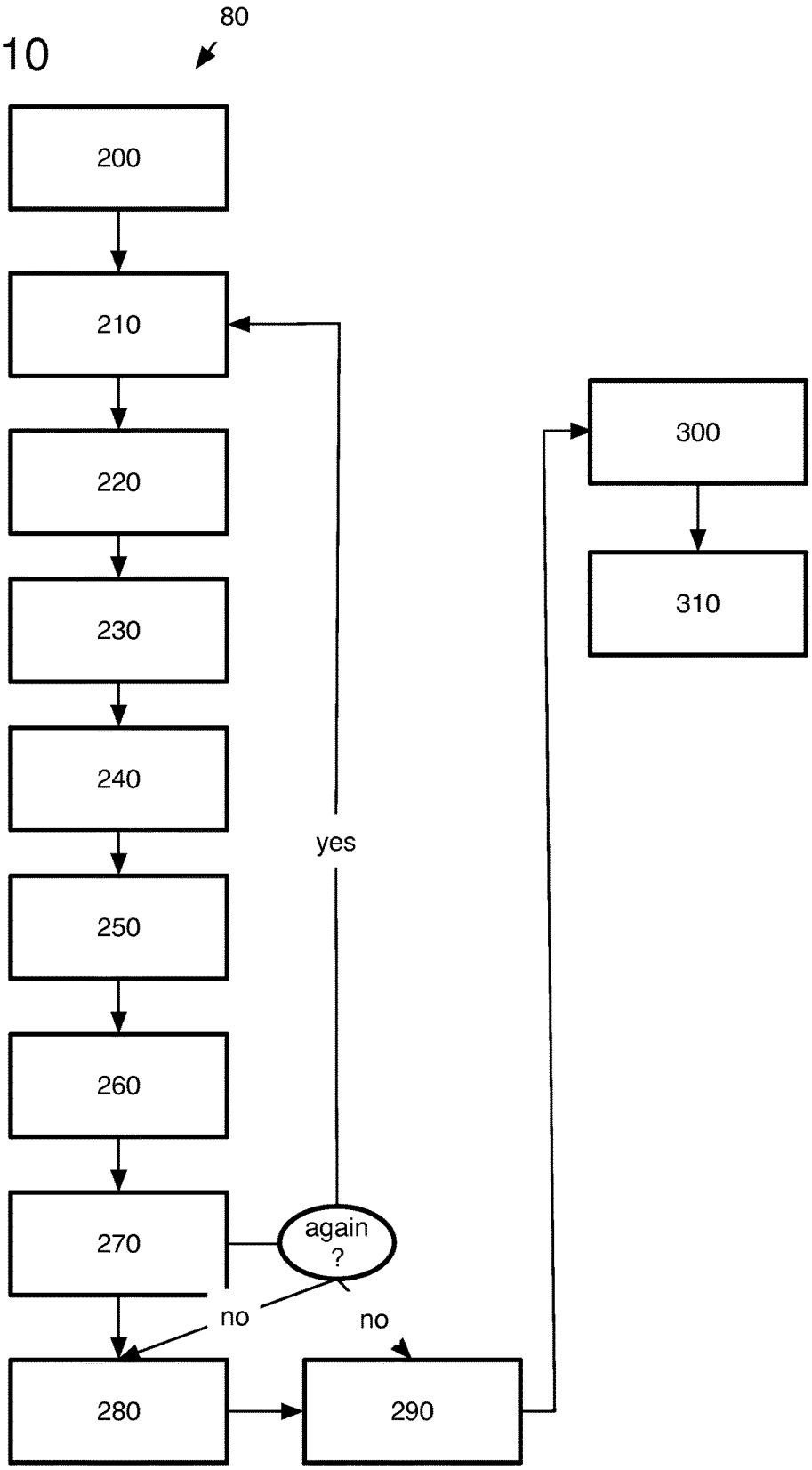
FIG. 10 is a block diagram of software according to a preferred embodiment of the present invention.

In one preferred embodiment, as FIG. 10 shows, software 80 resident on a host computer comprises a series of executable steps and manipulates data input by a user and renders a screen image based on input from a camera. Once the software is running on the computer (block 200), a user sets up the camera to view a physical target and then inputs to the computer for the software to capture an image of the target (block 210). Next, the user inputs any optional information related to the user's name, location of the shoot, distance to target, firearm used, ammunition used, and any other pertinent information (block 220). At this point the software now has a first image of the target prior to any shots being fired at the target and a second image that alternates on the screen. The second image is used for displaying, for example, the most recent shot fired and this second image includes an actual image of the target with the impression made by the round or bullet in the target. By alternating the display between the first image and a second image, or by any second image from a plurality of images, the shooter is able to see on the display whatever view desired. For example, a shooter may be interested in a grouping of multiple shots fired from firearm 1 and compare that to a grouping of shots fired from firearm 2, or shooter 1 may want to compare a grouping of shots relative to a second grouping of shots fired by shooter 2, or shooter 1 may just wish to see the most recent shot with all previous shots not displayed. By alternating the images on the display, the present invention is able to present the shooter these different views.

Next, the user fires his or her firearm (one shot) at the target and then inputs (block 230) to the computer by any one of several means for inputting to the computer including, but not limited to, verbal command, mouse click, keystroke, hand gesture, remote button actuation, or other similar input as would be well understood in the art. This triggers the camera to capture a second image (block 240) and send data representing that image to the computer and software. The software stores this data (block 250) and displays an image over the static target image (block 260). At this point the user has the option to select a color or to tag (block 270) the shot with any identification information that is relevant. This allows the user to switch sidearms, or for multiple users to take shots at the same physical target.

The user continues to take shots at the target and input to the computer each shot as just described, above. After each shot the user can store, tag and view the shot on the screen. The user can view all the shots on the screen at the same time (block 280) or may alternate the images so that only the most recent shot appears on the screen (290).

When the shooter has completed a shooting session, the data may be stored to any storage medium, such as a hard drive on the computer, or to a flash drive, or uploaded to the Cloud, etc. (block 300). And, either in real-time, or at a later time, the user can review any one or any plurality of saved shots on the screen so that the user can self-assess, or share with others to compare shooting ability or for shooting instruction and improvement (block 310).

Figure 13:
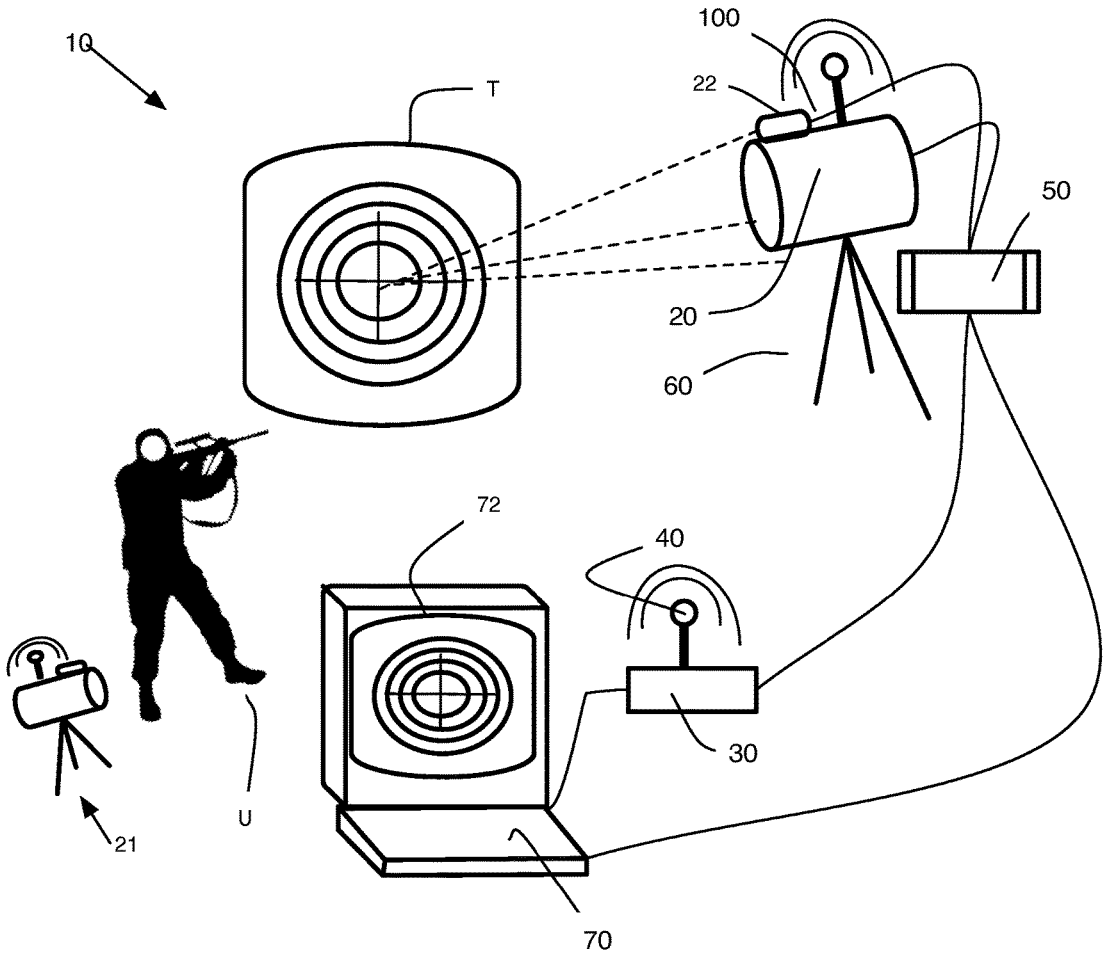
FIG. 13 is a schematic diagram of a second preferred embodiment of the present invention.

FIG. 13 shows a second preferred embodiment of the present invention. Here, two cameras are used. One camera is focused on the target, as previously described. The second camera is aimed at the shooter to record technique, body position, etc. The second camera communicates with the computer by wired or wireless connections.

As an improvement over the embodiment discussed above, the present invention contemplates a second camera adapted to capture a real-time image of the shooter taking a shot and correlating that image with the target image. It will be appreciated by those skilled in the art that this arrangement will be well suited for use as a certified training tool. For example, law enforcement agencies require periodic and regular time on the shooting range for all personal that carry sidearm and the present invention can be used to record the shooter as he or she shoots, and record the accuracy of multiple shots for certification compliance uses, for example.

Additionally, the image of the shooter, real-time, and correlated to the image of the shot on the target can further aid training by allowing the shooter to review the images to note body position, hand position, follow-through, and other aspects of firearm handling before, during, and after a shot fired to critique and improve technique.

For purposes of certification, the two images (shooter and target) would also include unique tagging of information (i.e. watermarked or clearly displayed and embedded) with user supplied information such as name, badge number, instructor name, time, place, location, ambient conditions, range name, type of firearm, ammunition, or any other data that is available at the time the shot was fired. If used at an outdoor range the current weather conditions can be pulled from the Internet (i.e. weather.com) or otherwise inputted.

The camera or cameras can capture multiple views, such as a wind meter on the range. This portion of the image can be presented on the computer screen by clipping (cropping the image) we can display that device in a separate window—so you could have a wind meter at the shooting location, but still have the software just "show" your target on the screen, then show the wind meter in a separate window.

This system can readily be adapted for use in other sports where a first camera could capture where the shot landed (such as golf) and a second camera could be focused on the player to capture body position and technique. Accordingly, this invention would work well in other sports including baseball, or tennis for example. Additionally, the present invention could be used as a training tool in a myriad of applications including place kicking for football, at the golf driving range, at the batting box, and other similar activities.

Other improvements include that the camera, battery, and router all stay at (near) the target and broadcast back to the computer.

The image on the computer can be alternated with a second or any other subsequent image. Thus, by alternating two or more images, such as a first image having a clean target image with a second image having of a recent shot fired and the corresponding hole in the target, the viewer will see the recent shot "highlighted" visually on the screen. Further, the current shot can be shown in context of all previous shots, by leaving the old shots on the frame with the blank target and then "blinking" the current shot.

The software provides the ability to click on thumbnail images to review past shots. The system comes in a packaged "kit" or "toolbox" that holds all necessary parts and those parts, with the exception of the software stay down at the target location.

Other improvements include super imposing, or attaching via meta data user defined information about the shooter i.e. badge number, instructor number, conditions of the shot, caliber, ammunition, load data, etc. on each and every shot image;

A camera that records the shooter as he or she shoots. This shows shooting form, mistakes, etc. The image and/or video can be viewed side by side or simultaneously with the target on the screen and the shooter on the screen so the shot can be correlated to the shooting technique.

A booster coupled with the router to enables data transfer to a computer at over 1000 yard distances. The camera can be equipped with infrared lights to "see" at night and enable image recording on the computer. In fact, the infrared light source can be placed anywhere and need to be coupled physically to the camera. The infrared light source need only illuminate the target and the reflected light will be 'read' by the camera. As those skilled in this art can appreciate, the ability to help recognize bullet holes on black targets—they are almost impossible to see at night and extremely difficult to see even under certain daylight conditions. The infrared light source combined with the camera's ability to capture the infrared spectrum along with thee computer and software's ability to transfer this data to a visible image on the computer display screen enables a shooter to better train and practice target shooting in low visibility conditions.

Using the MAC address of the computer or network card (or other unique hardware or software entered id value) to tag the image to prove what computer it came from for training scenarios.

Further, the present invention contemplates use of multiple cameras at the same time at different distances i.e. camera #1 is at 100 yards, camera #2 is at 200 yards, camera #3 is at 1000 yards.

The software either automatically or enables the user to crop an area of the camera's viewing range to use other devices such as a wind meter at the shooting and/or target location—so one camera can be used to monitor the target, and wind speed, temperature, etc. by the software knowing what to look at or crop out for each view.

The system contemplates interfacing a chronograph (or other devices) to log the bullet speed and tag it with each frame/image.

The system enables 2 or more shooters to shoot at one target and can then be used to assign which shooter is taking the shot. This reduces the need for new targets when there are multiple shooters. This can be further segmented by enabling the shooters to indicate on the computer a particular region of the target that they are using. For example, one shooter shoots upper left, a second shooter shoots lower right, you tell the software via a cropping rectangle what portion of the view belongs to which shooter. And, the software includes the ability to upload, backup and store all shooting profile data, images, etc. etc. in the "cloud" so that data is backed up and portable to any system at any location.

A shield can be placed around the camera to protect from bullets hitting the camera.

The software configures with a "tabbed" interface whereby multiple cameras and targets i.e. 100 yards, 200 yards, 1000 yards, can be selected by clicking the tab key and it shows the correct camera.

"Plug and play" components can utilize autodiscovery of the camera on the network using ip scanning or other universal plug and play to reduce set up time and complexity.

Other features include pairing/tagging the camera so the software can recognize it next time i.e. using the hardware id of the camera; allowing hardwired cameras via network cable for shooting ranges and places that want it hardwired and don't want to mess with wireless; the ability to password protect the data in the program so others can't see your data (critical for hand load development).

Figure 14:
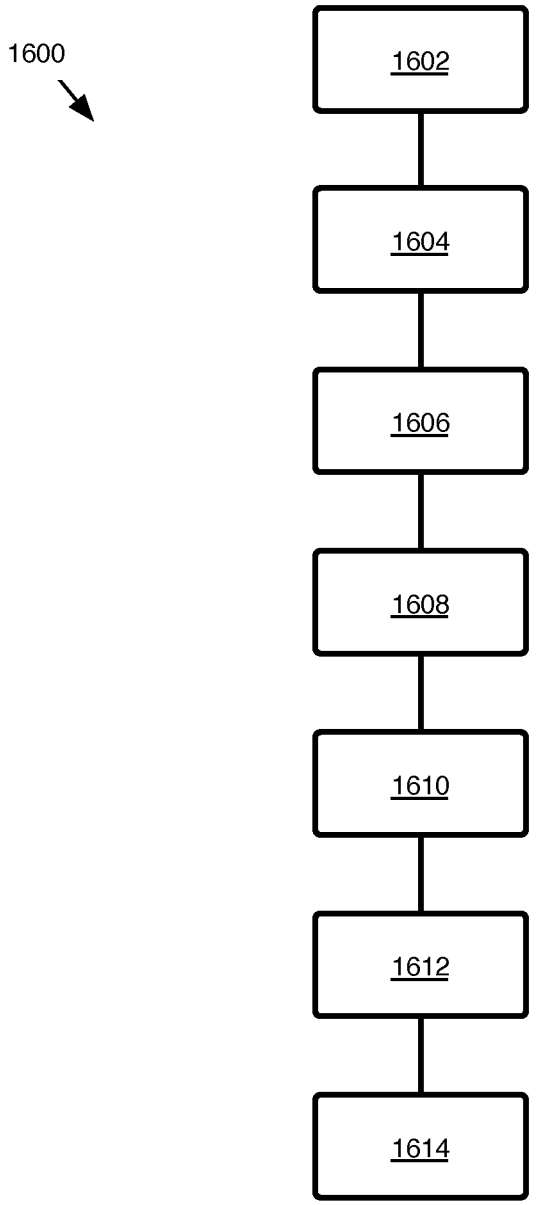
FIG. 14 illustrates one method according to a preferred embodiment of the present invention.

FIGS. 13 and 14 illustrate one contemplated preferred embodiment of the present invention includes a system 10 for improving shooting skill of a user having a conventional firearm configured to shoot ammunition at a physical target. The system includes a first camera 20, a second camera 21, both cameras configured to be in data communication with at least one computer 70 by means of a wireless or wired router 30. A conventional physical target T arranges at a predetermined distance from a user U (or shooter). Optionally, either or both cameras 20 and 21 include a light source, its configuration and use being well understood by those skilled in the art. The first camera 20 optionally includes a laser 22 for sighting the camera to the target. A power source 50, including a data drive and or communication equipment for sending and receiving data signals to and from the computer, can be remotely positioned relative to the camera and relative to the computer to provide a more secure location for data storage, for example.

Accordingly, the at least one computer 70 includes an executable software program. The executable software program 1600 is configured to capture a first image 1602 of the physical target, process a location of a first shot fired 1604 by capturing a second image from a camera 20 directed to the physical target T, display 1606 on a display 72 a first computer-processed representation of the first image, superimpose 1608 the location of the first shot fired on the display 72 a second computer processed representation of the second image, and associate 1610 at least one data-characteristic with the location of the first shot.

The first camera 20 is further configured to capture at plurality of images and transmit data 1612 of the plurality of images to the at least one computer. And, The first camera 20 further includes a laser 22 mounted to the first camera. The laser is configured to enable the user to align the camera relative to the physical target.

Additionally, the camera includes a tripod 60 supporting the first camera, a light source (not shown in the drawing) coupled to the first camera.

Further, the second camera 21 is configured to capture a plurality of images of the user U. The second camera is further configured to be in data communication with the at least one computer 70 and wherein the executable software program 1600 is further configured to capture 1614 at least one user-image of the user shooting the firearm and correlate 1616 the at least one user-image with the location of a first shot fired by capturing a second image from a camera directed to the physical target.

Figure 15:
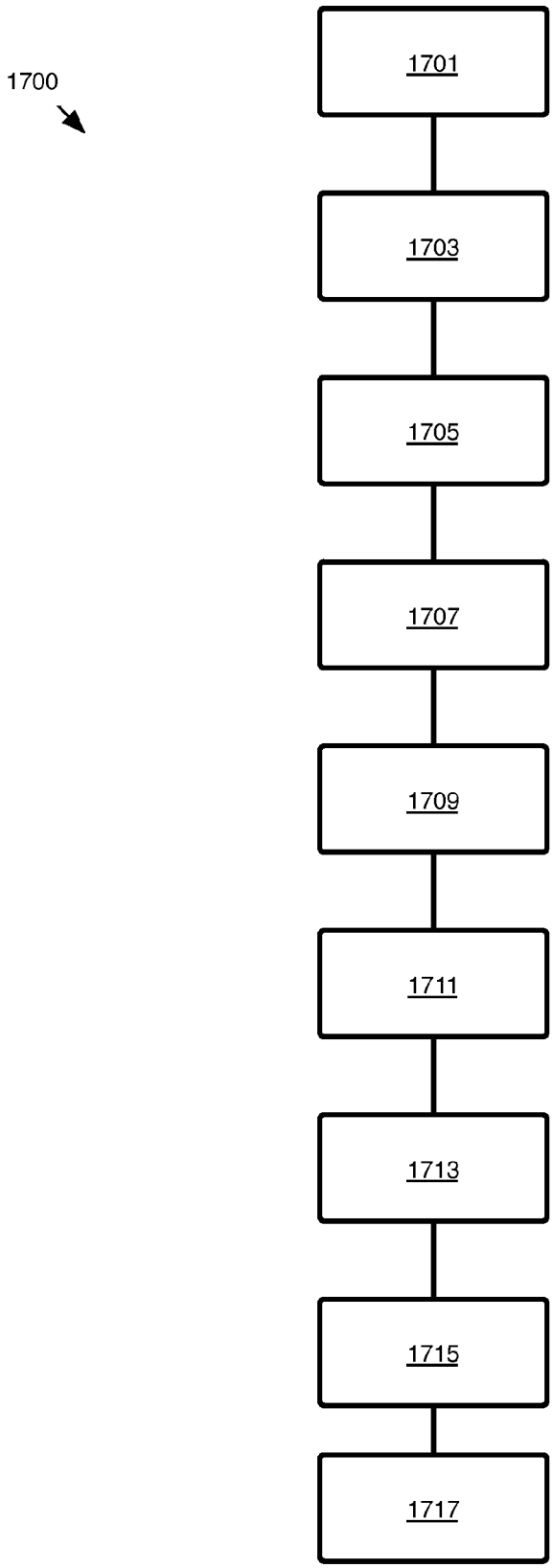
FIG. 15 illustrates another method according to another preferred embodiment of the present invention.

FIG. 15 shows a preferred method of a contemplated embodiment of the present invention. This method 1700 is a method for improving shooting skill of a user having a conventional firearm configured to shoot ammunition at a physical target. This method 1700 includes providing at least one computer 1701. The computer has an executable software program. The executable software program configured to capture a first image of the physical target, process a location of a first shot fired by capturing a second image from a camera directed to the physical target, display on a display a first computer processed representation of the first image, superimpose the location of the first shot fired on the display a second computer process representation of the second image, and associate at least one data-characteristic with the location of the first shot.

This method 1700 further includes the steps of: Providing 1703 a first camera configured to be in data communication with the executable software program on the at least one computer; Using the first camera, capturing 1705 a first image of the physical target; representing 1707 the first image of the physical target on a display; using the first camera, capturing 1709 a second image of the physical target wherein the second image includes at least one physical representation of a shot fired; displaying 1711 the second image on the display; determining 1713 the location of at least one of a plurality of physical representations of a shot fired; associating 1715 at least one of a plurality of characteristics with the location of at least one of a plurality of physical representations of a shot fired; and configuring 1717 the computer to display a most-recent-shot by alternating with a first or other image of previous-shots fired from the display by altering a first and second image on the display. In this manner, the latest shot—or more particularly—the differences between the first image and second image are highlighted by the oscillation of the images on the display. Much like how a sequence of cartoon images mimic movement when viewed in rapid succession, the present invention relies on the alternating images. Thus, the information captured by the two images that is constant, such as the target location, size, shape, markings etc., while visible in both images, this information appears static to the viewer. However the differences between the two images, for example a new hole in the target, will appear on the second image but not the first image. And the alternating nature of the two images will cause the viewer to see a "blinking" hole that represents the latest shot. In reality the hole is not blinking, but is rather being displayed in the second image and is absent in the first image, but because the two images are alternating on the display it is highlighted to the viewer.

Additionally, this method 1700 further includes: providing 1719 a second camera configured to capture a plurality of images of the user, the second camera further configured to be in data communication with the at least one computer and wherein the executable software program is further configured to capture at least one user-image of the user shooting the firearm and correlate the at least one user-image with the location of a first shot fired by capturing a second image from a camera directed to the physical target; capturing 1721 at least one user-image of the user shooting the firearm; and correlating 1723 the at least one user-image to the location of at least one of a plurality of physical representations of a shot fired.

Finally, it will be appreciated by those skilled in the art that the various components of the present invention may be physically arranged in many different layouts. The components need not be in physical proximity to each other, nor do they require a wired connection. The computer can be remotely located and in data communication with the camera by standard wifi, by a booster or router, or by other well-understood means. Obviously, the camera needs to be able to 'see' the target and the infrared light source must be close enough to the target to effectively illuminate it, but again, these components need not be coupled to each other.

Although the invention has been particularly shown and described with reference to certain embodiments, it will be understood by those skilled in the art that various changes in form and detail may be made without departing from the spirit and scope of the invention.

I claim:

1. A system for improving shooting skills of a user shooting at a physical target, the system comprising:

a first camera comprised of a laser mounted to the first camera, the laser configured to enable the user to align the first camera relative to the physical target; and a computer having an executable software program, the computer comprising a processing unit, a system memory, at least one input device and at least one output device wherein the processing unit, the system memory, the at least one input device and the at least one output device communicate directly or indirectly through a bus; the system memory configured to store the executable software program;

the executable software program configured to:

capture a first image of the physical target from the first camera directed to the physical target before any shots are fired;

capture a second image of the physical target from the first camera, the second image being captured after a shot is fired at the physical target;

display on a display a computer-processed representation of the first image and repeatably alternating the first image with the second image whereby the shot fired at the physical target appears to blink on the display; and allow the user to associate at least one data-characteristic with a location of the shot on the computer-processed representation on the display.

2. The system of claim 1 further comprising:

a tripod supporting the first camera.

3. The system of claim 1 further comprising:

a light source coupled to the first camera.

4. The system of claim 1 further comprising:

a wireless router configured to enable the computer to send and receive data signals to and from the first camera.

5. The system of claim 1 further comprising:

a second camera configured to capture a user-image of the user, the user-image being captured after the shot is fired at the physical target, the second camera further configured to be in data communication with the computer; and the executable software program is further configured to correlate the user-image of the user with a location of the shot on the computer-processed representation on the display as represented in the second image from the first camera directed to the physical target.

6. A method for improving shooting skills of a user having a conventional firearm configured to shoot ammunition at a physical target, the method comprising:

selecting a computer comprising an executable software program and at least a first camera, the first camera comprised of a laser mounted to the first camera, the laser configured to enable the user to align the first camera relative to the physical target;

wherein the computer comprises a processing unit, a system memory, at least one input device and at least one output device wherein the processing unit, the system memory, the at least one input device and the at least one output device communicate directly or indirectly through a bus; the system memory configured to store the executable software program; and the executable software program is configured to:

capture a first image from the first camera of the physical target before any shots are fired at the physical target;

enable the user to input that a shot has been fired at the physical target;

capture a second image of the physical target from the first camera; and display on a display coupled to the computer the first image repeatedly alternating with the second image whereby the shot appears to blink on the display;

enable the user to click or touch the display on a display location representing the shot;

and associate at least one of a plurality of characteristics with the display location representing the shot.

7. The method of claim 6 further comprising:

selecting a second camera configured to capture a plurality of images of the user, the second camera further configured to be in data communication with the computer and wherein the executable software program is further configured to correlate at least one user-image with the display location representing the shot.

8. The system of claim 4 wherein the wireless router further comprises:

a WIFI enabled device configured to enable data communication from the first camera to the computer.

* * * * *